US007664452B2

(12) United States Patent
Nakajima

(10) Patent No.: US 7,664,452 B2
(45) Date of Patent: Feb. 16, 2010

(54) FIXING DEVICE, AND IMAGE FORMING APPARATUS PROVIDED WITH THE SAME

(75) Inventor: Eiji Nakajima, Osaka (JP)

(73) Assignee: Kyocera Mita Corporation (JP)

( * ) Notice: Subject to any disclaimer, the term of this patent is extended or adjusted under 35 U.S.C. 154(b) by 0 days.

(21) Appl. No.: 12/122,030

(22) Filed: May 16, 2008

(65) Prior Publication Data

US 2008/0292377 A1 Nov. 27, 2008

(30) Foreign Application Priority Data

May 22, 2007 (JP) ..... 2007-135307
May 22, 2007 (JP) ..... 2007-135308

(51) Int. Cl.
*G03G 15/20* (2006.01)

(52) U.S. Cl. ..... 399/329; 399/330; 399/331; 219/216

(58) Field of Classification Search ..... 399/126, 399/330, 331, 329; 219/216, 469–471
See application file for complete search history.

(56) References Cited

U.S. PATENT DOCUMENTS 7,392,006 B2 * 6/2008 Kameda et al. ..... 399/329
2006/0245800 A1 * 11/2006 Fujino ..... 399/329
2007/0059060 A1 3/2007 Kameda et al.
2008/0131179 A1 * 6/2008 Tsunoda ..... 399/331

FOREIGN PATENT DOCUMENTS

CN 1932684 3/2007
JP 2004-77871 3/2004

* cited by examiner

*Primary Examiner*—David M Gray
*Assistant Examiner*—Barnabas T Fekete
(74) *Attorney, Agent, or Firm*—Gerald E. Hespos; Anthony J. Casella

(57) ABSTRACT

A fixing device includes: a fixing roller; a support roller arranged apart from the fixing roller; an endless fixing belt wound around the fixing roller and the support roller; a pressing roller for applying a pressure force to the fixing roller while the fixing belt being sandwiched between the fixing roller and the pressing roller; a nip extending member arranged on an upstream of the fixing roller and on an inner side of the fixing belt and having a pressing surface for pressing the fixing belt; and a variable mechanism for changing a state of a pressure applied to the fixing belt by the nip extending member.

11 Claims, 6 Drawing Sheets

FIXING DEVICE, AND IMAGE FORMING APPARATUS PROVIDED WITH THE SAME

BACKGROUND OF THE INVENTION

1. Field of the Invention

The present invention relates to a fixing device for fixing a toner image onto a transfer member, and an image forming apparatus provided with the same.

2. Description of the Related Art

Image forming apparatuses such as a copying machine, a printer, and a facsimile machine include an image forming section for forming a visible toner image from an electrostatic latent image formed on a photoconductive member and transferring the toner image onto a transfer sheet, and a fixing device for fixing the toner image onto the transfer sheet.

As shown in FIG. 5, the fixing device includes a known belt-type fixing device in which an endless fixing belt 100 is wound around a fixing roller 101 and a support roller 102. In this fixing device, the fixing roller 101 is pressed by a pressing roller 103 in such a state where the fixing belt 100 is nipped between the fixing roller 101 and the pressing roller 103 (for example, refer to Japanese Patent Unexamined Publication No. 2004-77871).

Meanwhile, a color image forming apparatus uses greater amount of toners at a time of fixing than a monochromatic image forming apparatus does. Therefore, it is necessary to have a longer time (nipping time) of allowing a transfer sheet to be in contact with the fixing belt. Accordingly, as shown in FIG. 5, a slide pressing member 110 is arranged on an upstream side of the fixing roller 101 and on an inner side of the fixing belt 100. The slide pressing member 110 presses the pressing roller 103 while the fixing belt 100 being sandwiched between the fixing roller 101 and the pressing roller 103.

As shown in FIG. 6, the slide pressing member 110 is supported by a pivot shaft 110*a* parallel to a rotational shaft 103*a* of the pressing roller 103. Therefore, the pressing roller 103 can be pressed evenly in a circumferential direction of the pressing roller 103.

However, a state of pressure applied by the slide pressing member 110 along a longitudinal direction (rotation axis direction) of the pressing roller 103 depends on parts accuracy of the slide pressing member 110, the pressing roller 103, and the like. Thus, for example, in a case where a change in an outer diameter of the pressing roller 103 occurs, a tension between the slide pressing member 110 and the pressing roller 103 differs along a longitudinal direction of the pressing roller 103. As a result, running of the fixing belt 100 is disturbed on a side having a greater tension so that disadvantageous snaking of the fixing belt 100 occurs. Further, unevenness in the tension along the longitudinal direction of the pressing roller 103 had been likely to cause unevenness in luster.

SUMMARY OF THE INVENTION

An object of the present invention is to provide a fixing device capable of preventing snaking of a fixing belt and preventing occurrence of unevenness in luster, and an image forming apparatus provided with the same.

A fixing device in accordance with an aspect of the present invention for achieving the object includes: a fixing roller; a support roller arranged apart from the fixing roller; an endless fixing belt wound around the fixing roller and the support roller; a pressing roller for applying a pressure force to the fixing roller while the fixing belt being sandwiched between the fixing roller and the pressing roller; a nip extending member arranged on an upstream of the fixing roller and on an inner side of the fixing belt and having a pressing surface for pressing the fixing belt; and a variable mechanism for changing a state of a pressure applied to the fixing belt by the nip extending member.

Further, an image forming apparatus in accordance with another aspect of the present invention includes: an image forming section for forming a toner image and transferring the toner image onto a transfer member; and a fixing device for fixing the toner image onto the transfer member, and the fixing device has the configuration described above.

These and other objects, features and advantages of the present invention will become more apparent upon reading of the following detailed description along with the accompanied drawings.

DETAILED DESCRIPTION OF THE PREFERRED EMBODIMENTS

Hereinafter, embodiments of the present invention will be described in detail with reference to the drawings.

First Embodiment

Figure 1:
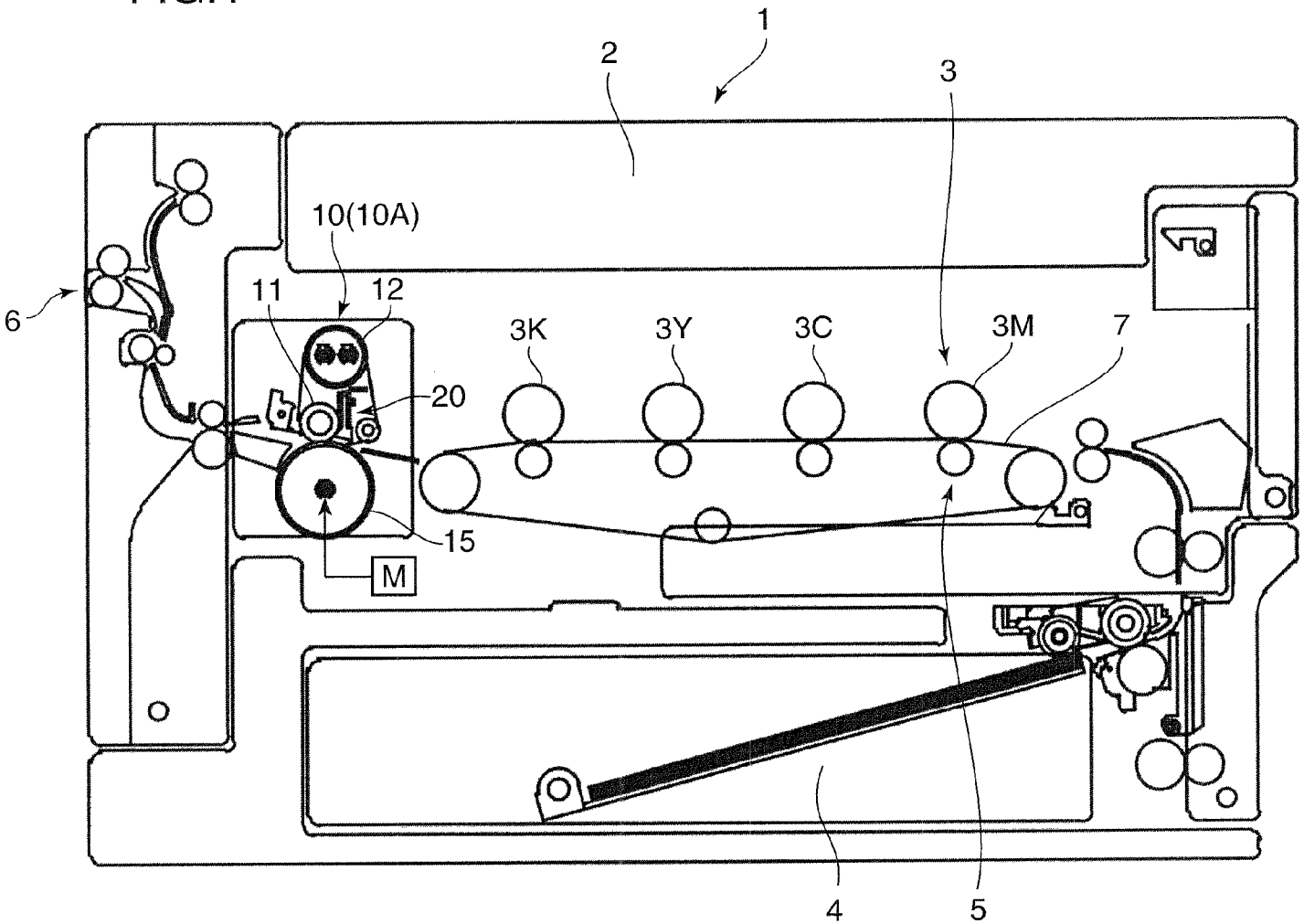
FIG. 1 is a front sectional view showing an internal structure of an image forming apparatus provided with a fixing device in accordance with the present invention.

FIG. 1 is a front sectional view showing an internal structure of an image forming apparatus 1 provided with a fixing device in accordance with the present invention. The image forming apparatus 1 is a color copying machine including an optical section 2, an image forming section 3, a sheet-feeding section 4, a fixing section 10 (fixing device), and a sheet discharging section 6.

The optical section 2 is adapted to read an image of a document to be copied and includes an optical unit for reading a document image optically to convert the document image into electric image data. The image forming section 3 is adapted to form a toner image of the document image and transferring the same onto a sheet (transfer member). The sheet-feeding section 4 stores a sheet onto which the toner image is transferred. As will be described herebelow, the fixing section 10 is adapted to heat and press the sheet onto which the toner image is transferred to fix the toner image onto the sheet. The sheet discharging section 6 includes a pair of sheet-discharging rollers to discharge the sheet on which the image is formed to outside of the apparatus.

The image forming section 3 includes a conveying belt 7 to be driven rotationally and image forming units for respective colors i.e. a magenta unit 3M, a cyan unit 3C, a yellow unit 3Y, and a black unit 3K provided sequentially along a rotational direction of the conveying belt 7 from an upstream side (right side) to a downstream side.

Each image forming unit includes a photoconductive drum having a surface on which an electrostatic latent image and a toner image are formed, a charging device for charging the surface of the photoconductive drum evenly, a developing device for supplying toners for developing the electrostatic latent image, a transferring roller opposing the photoconductive drum while sandwiching the conveying belt 7 therebetween to form a transferring section 5, and a cleaning device for cleaning the surface of the photoconductive drum. Further, the image forming section 3 includes an exposure device for irradiating a laser light modulated in accordance with image data of the document image to a respective peripheral surface of each photoconductive drum so as to form an electrostatic latent image.

At a time when a copying operation is performed, firstly, a document image is optically read by an optical section 2 provided on top of the apparatus so that image data of the document image is taken. Based on the image data, toner images of magenta, cyan, yellow, and black are formed on respective peripheral surfaces of the photoconductive drums of the image forming units for respective colors in the image forming section 3. The toner images of respective colors are transferred sequentially in superposition onto a sheet which is sent out from the sheet-feeding section 4 and conveyed on the conveying belt 7. After that, the sheet is conveyed to the fixing section 10 for the fixing processing, and then discharged to outside of the apparatus by the sheet discharging section 6.

Figure 2:
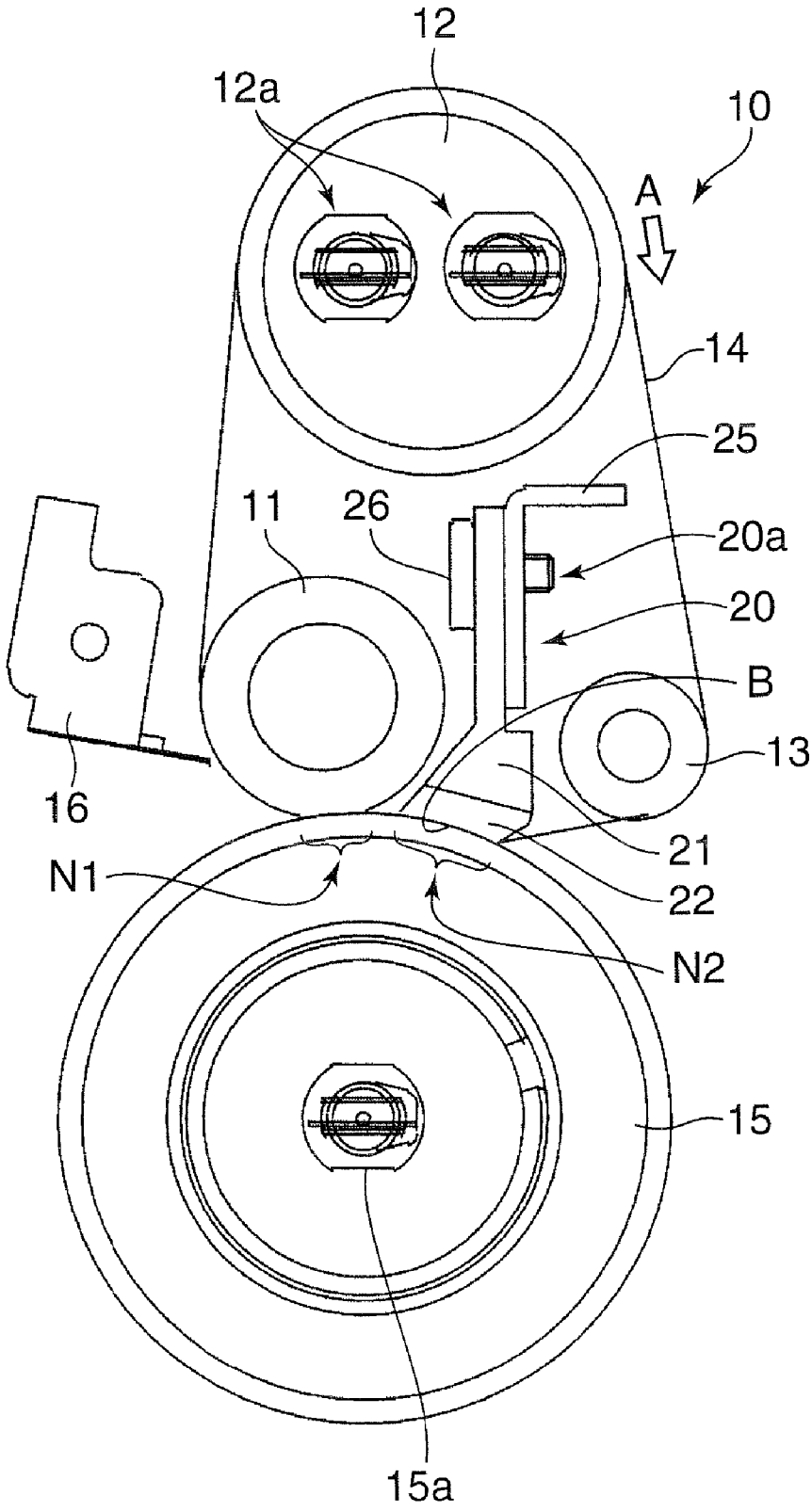
FIG. 2 is a front view showing a fixing device in accordance with a first embodiment.

FIG. 2 is a front view showing the fixing section 10 in an enlarged manner. The fixing section 10 includes a fixing roller 11, a support roller 12, a tension roller 13, a fixing belt 14, a pressing roller 15, a separating plate 16, and a nip extending member 20.

The fixing roller 11 includes a rotating member having an elastic layer on its surface. The support roller 12 is arranged above the fixing roller 11 and spaced apart from the fixing roller 11 by a predetermined distance. The tension roller 13 is arranged on an upstream side (right side in FIG. 2) of the fixing roller 11 in a sheet conveying direction. The pressing roller 15 is provided under the fixing roller 11. The support roller 12 and the pressing roller 15 have heaters 12*a* and 15*a* for generating a heat necessary for the fixing processing, respectively. The separating plate 16 is provided on a left side (a side of discharging the sheet) of the fixing roller 11.

The fixing belt 14 includes an endless belt-like member and is wound around the fixing roller 11, the support roller 12, and the tension roller 13. The pressing roller 15 applies a pressure force to the fixing roller 11 while the fixing belt 14 being sandwiched between the fixing roller 11 and the pressing roller 15. A fixing nip portion N1 is formed between the fixing belt 14 and the pressing roller 15 at a portion where the pressing roller 15 presses the fixing roller 11.

The longitudinal directions (axial directions) of the fixing roller 11, the support roller 12, the tension roller 13, and the pressing roller 15 are oriented in the same direction. Further, the tension roller 13 can be moved slightly in a substantially leftward and rightward direction in FIG. 2 so that the rightward movement allows the fixing belt 14 to fall in a tensed state and the leftward movement allows the fixing belt 14 to fall in a loosened state.

The pressing roller 15 is rotationally driven in a counterclockwise direction by an electric motor M shown in FIG. 1. The rotation of the pressing roller 15 rotates the fixing belt 14 in a clockwise direction (direction of arrow A in FIG. 2). A size in the longitudinal direction (axial direction) of the pressing roller 15 is substantially the same as a size in the width direction (a direction perpendicular to the sheet conveying direction) of the fixing belt 14.

The sheet onto which the toner image is transferred in the image forming section 3 is conveyed from the left side to the right side through the pressing roller 15 and the fixing belt 14, thereby passes through the fixing nip portion N1. The fixing belt 14 is heated by the heater 12*a* of the support roller 12, and the pressing roller 15 is also heated by the heater 15*a*. Further, since the pressing roller 15 is pressed toward the fixing roller 11, a pressure is applied to the fixing nip portion N1. Thus, the sheet which passes through the fixing nip portion N1 is heated and pressed, so that the toner image is fixed onto the sheet. The separating plate 16 is adapted to separate the sheet which passes through the fixing nip portion N1 from the fixing belt 14.

In addition to the configuration described above, the fixing section 10 of the present embodiment includes the nip extending member 20. The nip extending member 20 is arranged on an upstream side of the fixing roller 11 in a rotational direction of the fixing belt 14 (direction A) and on an inner side of the fixing belt 14 and has a pressing surface B capable of pressing the fixing belt 14 from an inner side toward a peripheral surface of the pressing roller 15. At the portion where the nip extending member 20 presses the pressing roller 15, an extended nip portion N2 is formed between the fixing belt 14 and the pressing roller 15. The extended nip portion N2 is formed on an upstream side of the fixing nip portion N1 in the sheet conveying direction to make a contact time (nipping time) between the sheet and the fixing belt 14 be long.

Figure 3B:
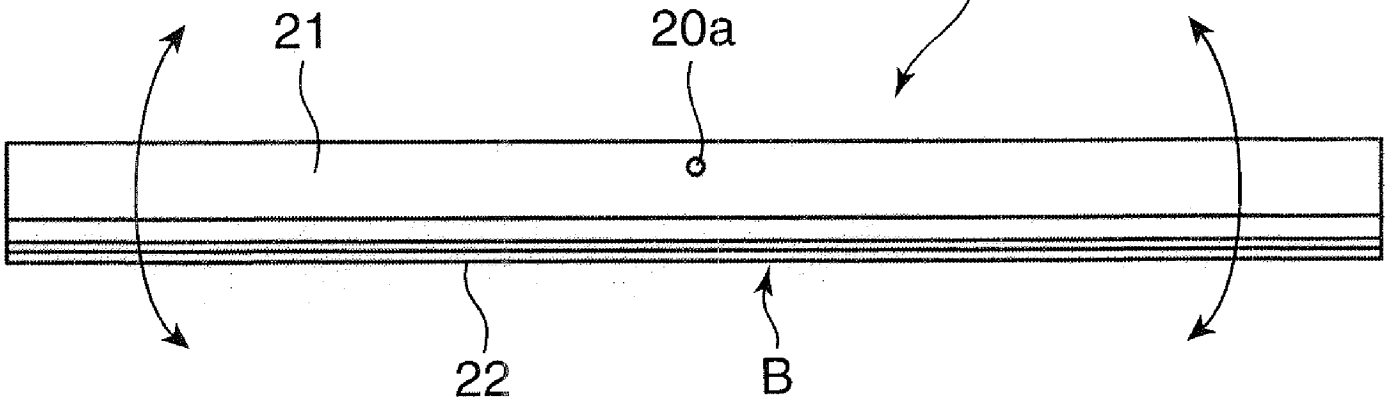
FIG. 3B is a right side view of the same.
Figure 3A:
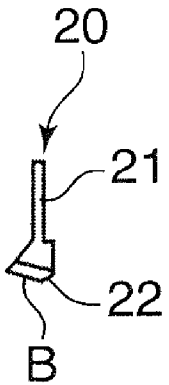
FIG. 3A is a front view showing a nip extending member.

The nip extending member 20 is supported by a support pin 26 (variable mechanism: swing mechanism: retaining member) on a mounting plate 25 fixedly mounted to a frame provided inside the apparatus main body of the image forming apparatus 1. FIG. 3A is a front view of the nip extending member 20, and FIG. 3B is a right side view of the same. The nip extending member 20 includes a supporting member 21 made of a metal and an elastic member 22 attached to a lower end of the supporting member 21. The pressing surface B is a lower end surface (a surface opposing the peripheral surface of the pressing roller 15) of the elastic member 22.

The nip extending member 20 is long in the width direction of the fixing belt 14, and its substantially center portion in the longitudinal direction is pivotally supported by the support pin 26. A part of the nip extending member 20 supported by the support pin 26 serves as a support shaft 20*a*. Rotation of the nip extending member 20 about the support shaft 20*a* changes height positions at one end side and the other end side of the pressing surface B in the longitudinal direction (the width direction of the fixing belt 14) to be relatively different. In other words, a state of pressure applied by the nip extending member 20 to the fixing belt 14 changes.

As the supporting member 21 made of a metal, for example, aluminum may be used. As the elastic member 22, for example, a silicon rubber may be used. Further, lengths of the nip extending member 20, the fixing roller 11, and the pressing roller 15 in the width direction may be so set as to be substantially the same. Further, the width dimension of the fixing belt 14 is so set as to be substantially the same as a length dimension of the nip extending member 20.

According to the fixing section 10 in accordance with the first embodiment, the nip extending member 20 is so provided as to be pivotal about the support shaft 20*a*. Accordingly, a tension which occurs between the nip extending member 20 and the pressing roller 15 becomes even along the width direction of the fixing belt 14. In other words, in a case where a difference in the tension occurs along the longitudinal direction of the pressing roller 15 due to a change in an outer diameter of the pressing roller 15, a side of the nip extending member 20 having a greater tension (a side close to the pressing roller 15) pivotally moves away from the pressing roller 15. Therefore, the tension becomes even along the width direction of the fixing belt 14. Thus, snaking of the fixing belt 14 can be prevented. Further, since the tension becomes even along the width direction of the fixing belt 14, occurrence of unevenness in luster of the sheet after the image forming can be prevented.

Second Embodiment

Figure 4:
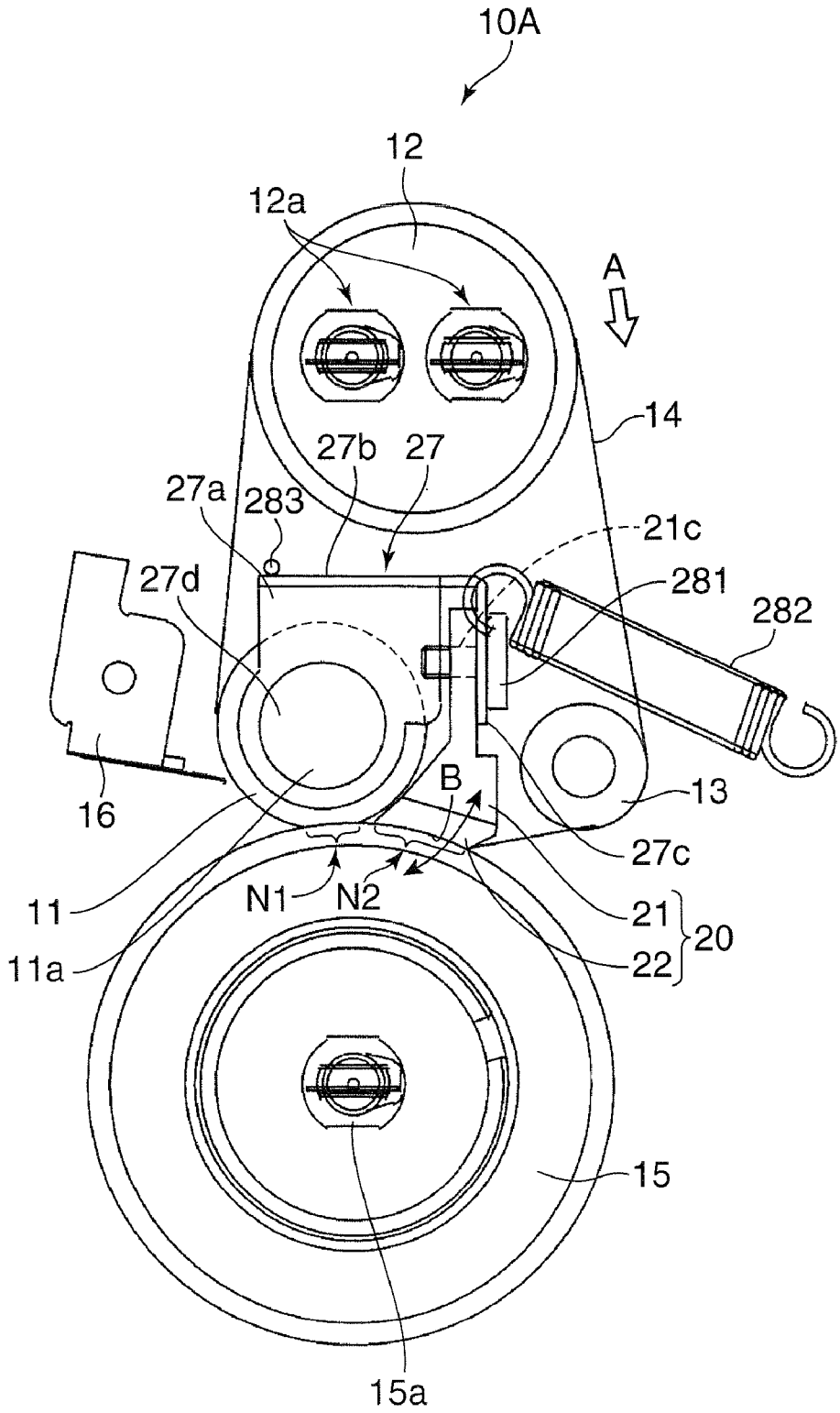
FIG. 4 is a front view showing a fixing device in accordance with a second embodiment.

Next, a fixing section 10A in accordance with a second embodiment of the present invention will be described with reference to FIG. 4. In FIG. 4, portions identified with the same reference signs as those of FIG. 2 indicates the same portions, and description about those will be omitted or simplified.

Figure 5:
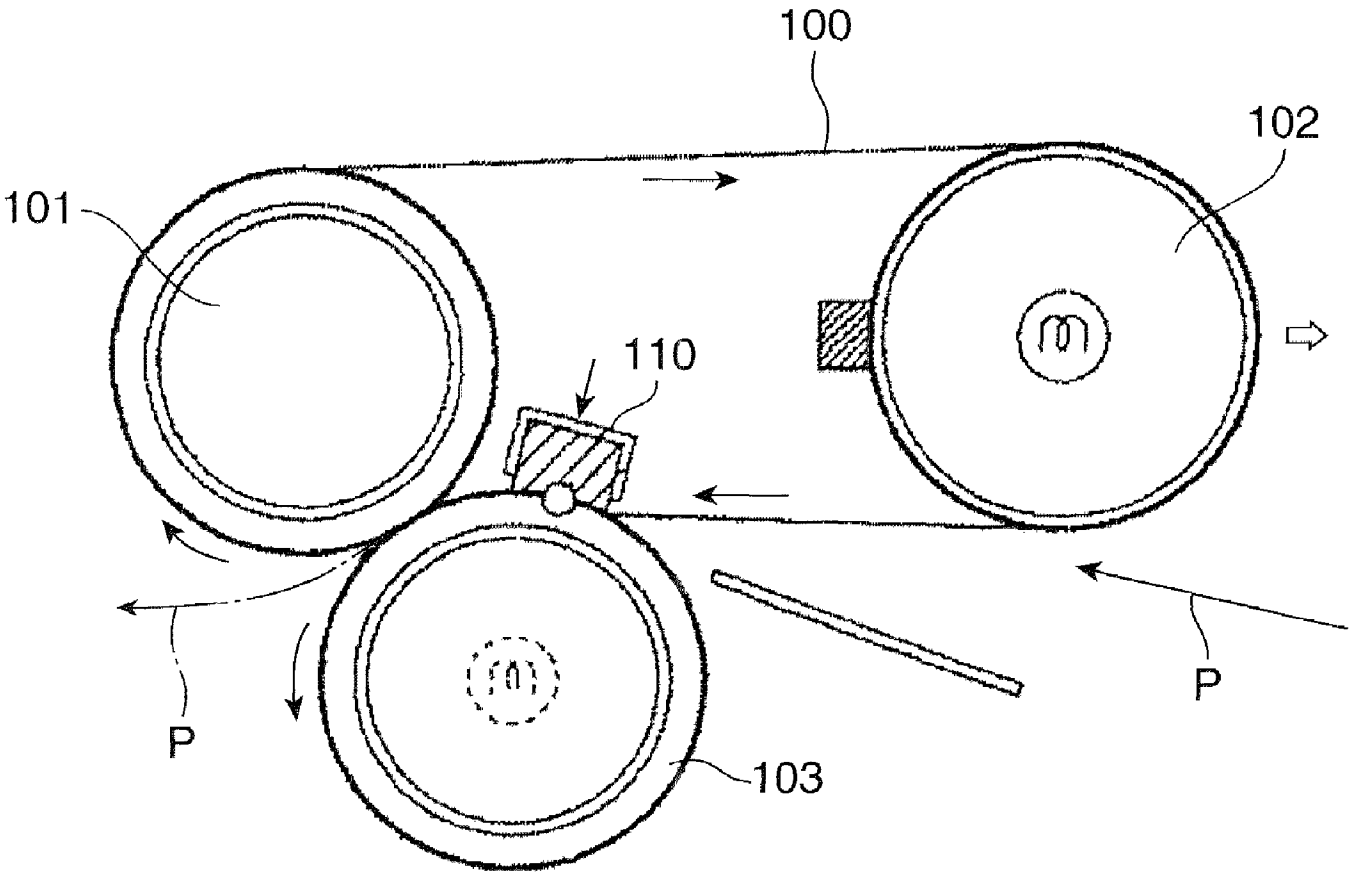
PRIOR ART FIG.5
FIG. 5 is a front view showing a conventional fixing device.
Figure 6:
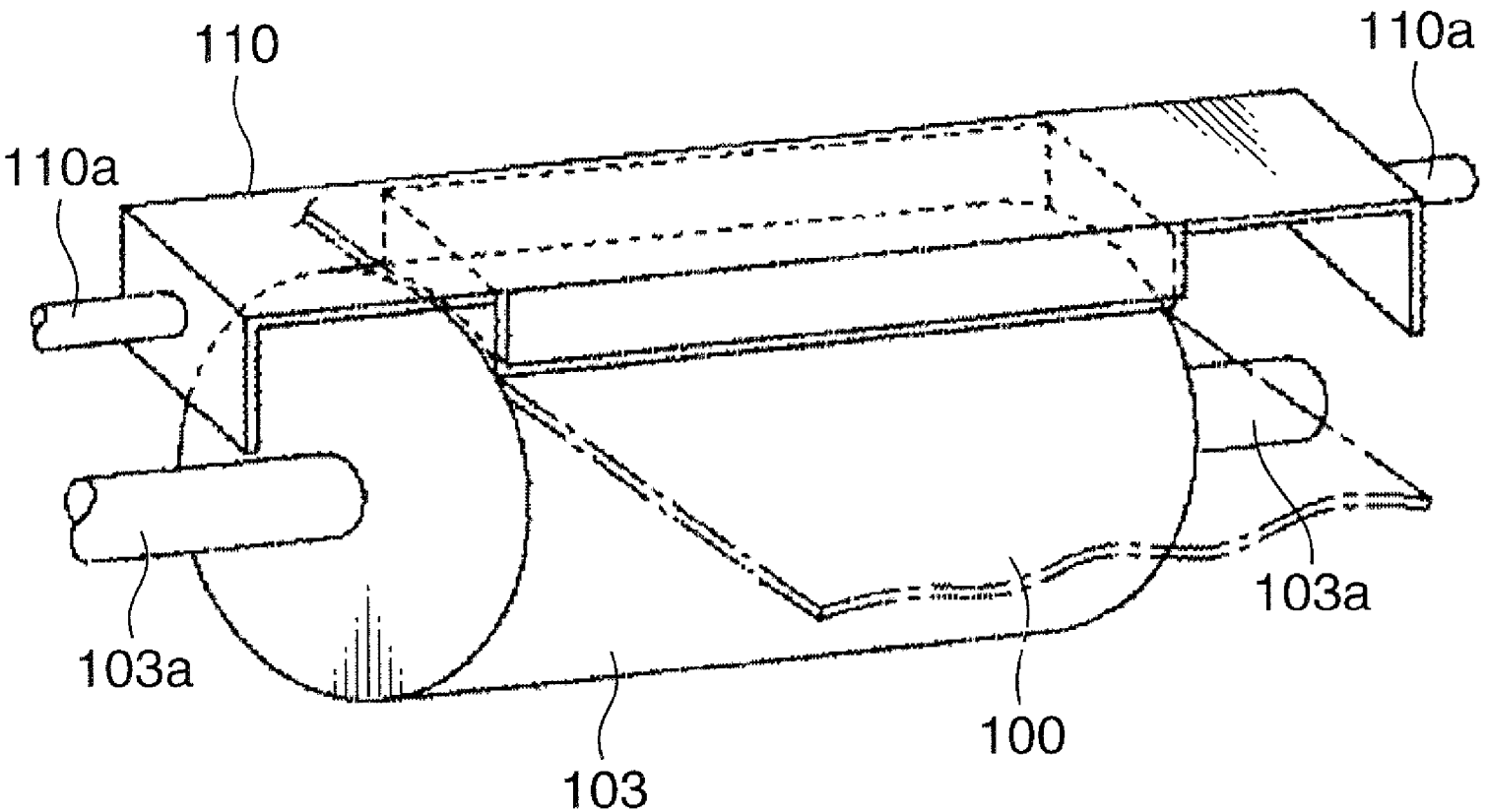
PRIOR ART FIG.6
FIG. 6 is a perspective view showing a conventional slide pressing member.

Referring to the conventional fixing device shown in FIGS. 5 and 6, the slide pressing member 110 is supported by a pivot shaft 110*a* parallel to the rotational shaft 103*a* of the pressing roller 103. In other words, since the slide pressing member 110 and the fixing roller 101 have individual rotational shafts, it is necessary that a clearance which is larger than a predetermined clearance is formed between the slide pressing member 110 and the fixing roller 101. As a result, a positional relationship between the slide pressing member 110 and the fixing roller 101 becomes unstable, so that it may cause a pressure-omitted portion where a force of pressing the pressing roller 103 is not applied.

When the pressure-omitted portion occurs, the following problems may occur. Specifically, if a toner layer on a sheet to which a heat is applied by pressure of the slide pressing member 110 falls in a melted state, and the melted toner layer in the melted state is positioned at the pressure-omitted portion, a slight difference in speed which occurs between the fixing belt 100 and the pressing roller 103 causes an image to be blurred at the pressure-omitted portion. Further, unevenness in pressure between the pressure-omitted portion and front and rear portion thereof causes unevenness in luster. In addition to the advantages of the fixing section 10 in accordance with the first embodiment, the fixing section 10A in accordance with the second embodiment can make the pressure-omitted portion be small.

The fixing section 10A includes a fixing roller 11, a support roller 12, a tension roller 13, a fixing belt 14, a pressing roller 15, a separating plate 16, and a nip extending member 20, which are the same as the first embodiment. The fixing section 10A is different from the first embodiment in that the nip extending member 20 is supported by a supporting member 27 (a part of variable mechanism: rotating mechanism) rotated about a rotational axis of the fixing roller 11 and that the nip extending member 20 is urged by a pulling coil spring 282 (a part of biasing member: the rotating mechanism).

Similarly to the first embodiment, the nip extending member 20 is arranged on an upstream side of the fixing roller 11 in the rotational direction (direction A) of the fixing belt 14 and on an inner side of the fixing belt 14. The supporting member 27 for supporting the nip extending member 20 includes a pair of vertical pieces 27*a* opposing each other and spaced apart by a distance longer than a length of the fixing roller 11 in a rotational axis direction, a horizontal connecting piece 27*b* connecting upper end portions of the pair of vertical pieces 27*a*, and an attachment piece 27*c* slightly extending rightward from the connecting piece 27*b* and so bent as to extend downward.

Each vertical piece 27*a* is formed with a circular hole 27*d*, and opposite ends of the shaft 11*a* of the fixing roller 11 are fitted respectively to the circular holes 27*d*. Accordingly, the supporting member 27 is rotatable about a rotational axis (shaft 11*a*) same as that of the fixing roller 11.

At a center portion of the attachment piece 27*c* in its longitudinal direction (width direction of the fixing belt 14), a hole (engaging portion) is formed through which a support pin 281 (retaining member) passes for supporting the nip extending member 20 pivotally. The support pin 281 is fitted to an attachment hole 21*c* formed in the supporting member 21 of the nip extending member 20 through the hole of the attachment piece 27*c*. The support pin 281 is the same as the support pin 26 in the first embodiment, and the nip extending member 20 is pivotal about the attachment hole 21*c* supported by the support pin 281.

Thus, in the second embodiment, the pressing surface B of the nip extending member 20 rotates about the support pin 281 to be vertically in the width direction of the pivotal fixing belt 14, and is pivotal about the shaft 11*a* of the fixing roller 11. In other words, the state of pressure applied by the fixing belt 14 by the nip extending member 20 can be changed in two directions.

One end of the pulling coil spring 282 is attached to the attachment piece 27*c*. The other end of the pulling coil spring 282 is attached to an unillustrated main body frame provided in a periphery of the fixing section 10A. The pulling coil spring 282 applies a biasing force to the supporting member 27 for rotating the supporting member 27 about the shaft 11*a* in a clockwise direction. This biasing force urges the pressing surface B of the nip extending member 20 in a direction of coming close to the fixing nip portion N1 which is formed by the fixing roller 11 and the pressing roller 15. As a result, a clearance between the fixing nip portion N1 and the extended nip portion N2 in the sheet conveying direction becomes narrow.

In a periphery of the supporting member 27, in particular, on an upper side of the connecting piece 27*b*, a stopper 283 is provided. If the supporting member 27 rotates about the shaft 11*a* to a predetermined angle, the stopper 283 comes in contact with the connecting piece 27*b* to restrict further rotation of the supporting member 27. This restriction prevents the leading end portion of the elastic member 22 on a side of the fixing nip portion N1 from being tucked into the fixing nip portion N1. A position of the stopper 283 is not limited to the position coming in contact with the connecting piece 27*b*. For example, the stopper 283 may be provided at a position of coming in contact with the vertical piece 27*a* or the attachment piece 27*c*.

According to the fixing section 10A in accordance with the second embodiment, the nip extending member 20 is attached to the supporting member 27 which is pivotal about the shaft 11*a* of the fixing roller 11, and the supporting member 27 is rotated by the pulling coil spring 282 so that the elastic member 22 (pressing portion B) of the nip extending member 20 comes close to the fixing nip portion N1. Thus, a distance between the elastic member 22 (extended nip portion N2) of the nip extending member 20 and the fixing nip portion N1 becomes short, so that the pressure-omitted portion can be made small. Accordingly, occurrence of a blurred image and unevenness in luster can be suppressed.

Further, the leading end portion of the elastic member 22 on the side of the fixing nip portion N1 is so deformed by elasticity of the elastic member 22 and rotational operation of the fixing belt 14 so as to come close to the fixing nip portion N1. Accordingly, the distance between the extended nip portion N2 and the fixing nip portion N1 becomes further short, so that the pressure-omitted portion can be made further small. At this time, the rotational angle of the supporting member 27 is restricted by the contact between the stopper 283 and the supporting member 27. Accordingly, tucking of the elastic member 22 into the fixing nip portion N1 can be prevented.

Further, the nip extending member 20 is supported pivotally about the support pin 281 (attachment hole 21*c*) as a support shaft. Accordingly, similarly to the first embodiment, a pressure which occurs between the nip extending member 20 and the pressing roller 15 can be made even throughout the longitudinal direction of the pressing roller 15. Accordingly, occurrence of unevenness in luster on the sheet after the image forming is performed can be prevented.

In the above, the first and second embodiments of the present invention are described. However, the present invention is not limited to those. For example, in the embodiments described above, the fixing sections 10 and 10A having the tension roller 13 is described as an example. However, the present invention may be adopted in a fixing section in which the fixing belt 14 is wound around the fixing roller 11 and the support roller 12.

Further, in the embodiments described above, the present invention is adopted in a color copying machine. However, it may be similarly adopted in a monochromatic copying machine. Further, in the embodiments described above, the present invention is adopted in a fixing section of a copying machine. However, the present invention may be surely adopted in a fixing section of a facsimile machine or a printer in a similar manner.

The embodiments described above mainly include the invention having the following configurations.

A fixing device in accordance with an aspect of the present invention includes: a fixing roller; a support roller arranged apart from the fixing roller; an endless fixing belt wound around the fixing roller and the support roller; a pressing roller for applying a pressure force to the fixing roller while the fixing belt being sandwiched between the fixing roller and the pressing roller; a nip extending member arranged on an upstream of the fixing roller and on an inner side of the fixing belt and having a pressing surface for pressing the fixing belt; and a variable mechanism for changing a state of a pressure applied to the fixing belt by the nip extending member.

According to this configuration, a state of pressure to the fixing belt by the nip extending member can be changed by the variable mechanism. Accordingly, tilting of the pressing surface in a width direction of the fixing belt and a strength of pressure with respect to the fixing belt can be adjusted properly.

In the configuration above, the variable mechanism may be a swing mechanism for changing vertical positions of the pressing surface of the nip extending member to be relatively different at one portion and the other portion in the width direction of the fixing belt. According to this configuration, adjusting a height position of the pressing surface can make a pressure force applied to the fixing belt be proper in the width direction of the fixing belt.

In this case, is preferable that the nip extending member be long in a width direction of the fixing belt and the swing mechanism be adapted to support the nip extending member pivotally about a portion corresponding to a substantially center portion in the longitudinal direction of the nip extending member.

According to this configuration, a tension between the nip extending member and the pressing roller can be made even in the longitudinal direction of the pressing roller. Even if the tension becomes different in the longitudinal direction of the pressing roller, the nip extending member swings so that the side having a greater tension (the side close to the pressing roller) moves apart from the pressing roller. Accordingly, the tension becomes even in the width direction of the fixing belt. Accordingly, snaking of the fixing belt can be prevented. Further, since the tension becomes even in the width direction of the fixing belt, occurrence of luster can be prevented.

In the configuration above, it is preferable that a driving device for rotationally driving the pressing roller be further provided and rotation of the pressing roller rotationally drive the fixing belt. Such configuration of driving is likely to cause snaking of the fixing belt. However, the snaking of the fixing belt may be prevented by adopting the present invention.

In the configuration above, it is preferable that the variable mechanism be a rotating mechanism for rotating the pressure surface of the nip extending member about an axis extending in a direction which is the same as that of a rotational axis of the fixing roller. According to this configuration, strength of the pressure applied by the pressing surface to the fixing belt can be adjustment freely.

In this case, it is preferable that the rotating mechanism includes: a supporting member supported at opposite end portions in a rotational axis of the fixing roller rotatably about the rotational axis; and a biasing member for applying a rotational force to the supporting member for rotation about the rotational axis, wherein the nip extending member is mounted to the supporting member, and the pressing surface is urged by the biasing member in a direction of coming close to a nip portion between the fixing roller and the pressing roller.

According to this configuration, a distance between a portion of the fixing belt where the nip extending member applies a pressure and the nip portion becomes short, so that the pressure-omitted portion can be made small. Accordingly, occurrence of a blurred image and unevenness in luster can be prevented.

In this case, it is preferable that the nip extending member includes an elastic member on the pressing surface. According to this configuration, the leading end portion of the nip extending member is so deformed by elasticity of the elastic member and rotational operation of the fixing belt as to come close to the nip portion. Accordingly, a portion of the fixing belt where the nip extending member applies a pressure and the nip portion becomes short, so that the pressure-omitted portion can be made further small. Accordingly, occurrence of a blurred image and unevenness in luster can be further prevented.

Further, it is preferable that the rotating mechanism includes a stopper for restricting rotation of the supporting member so that the elastic member is prevented from being tucked into the nip portion. According to this configuration, the stopper restricts rotation of the supporting member, so that tucking of the elastic member to the nip portion is prevented.

In the configuration above, it is preferable that the variable mechanism includes: a swing mechanism for changing vertical positions of the pressing surface of the nip extending member to be relatively different at one portion and the other portion in the width direction of the fixing belt; and a rotating mechanism for rotating the pressure surface of the nip extending member about an axis extending in a direction which is the same as that of a rotational axis of the fixing roller.

Especially, it is preferable that the nip extending member is long in a width direction of the fixing belt, and the swing mechanism is adapted to support the nip extending member pivotally about a portion corresponding to a substantially center portion in the longitudinal direction of the nip extending member, and the variable mechanism includes: a supporting member supported at opposite end portions in a rotational axis of the fixing roller rotatably about the rotational axis; and a biasing member for applying a rotational force to the supporting member for rotation about the rotational axis, and the nip extending member is mounted to the supporting member, and the pressing surface is urged by the biasing member in a direction of coming close to a nip portion between the fixing roller and the pressing roller.

According to this configuration, snaking of the fixing belt can be prevented, and the pressure-omitted portion can be made small.

A fixing device in accordance with another aspect of the invention includes: a fixing roller; a support roller arranged apart from the fixing roller; an endless fixing belt wound around the fixing roller and the support roller; a pressing roller for applying a pressure force to the fixing roller while the fixing belt being sandwiched between the fixing roller and the pressing roller; a nip extending member arranged on an upstream of the fixing roller and on an inner side of the fixing belt and having a pressing surface for pressing the fixing belt; and a retaining member for supporting the nip extending member pivotally at a portion corresponding to a substantially center portion in a longitudinal direction of the nip extending member.

According to this configuration, the nip extending member is supported by the retaining member pivotally, so that a tension which occurs between the nip extending member and the pressing roller can be made even in the longitudinal direction of the pressing roller. Thus, snaking of the fixing belt can be prevented, and occurrence of unevenness in luster can be prevented.

In the configuration above, it is preferable that the fixing device further includes: a supporting member supported at opposite end portions in a rotational axis of the fixing roller rotatably about the rotational axis; and a biasing member for applying a rotational force to the supporting member for rotation about the rotational axis, wherein the nip extending member is mounted to the supporting member by the retaining member, and the pressing surface is urged by the biasing member in a direction of coming close to a nip portion between the fixing roller and the pressing roller.

According to this configuration, a distance between the portion of the fixing belt where the nip extending member applies a pressure and the nip portion can be made small so that the pressure-omitted portion can be made small. Accordingly, occurrence of a blurred image and unevenness in luster can be prevented.

In this case, it is preferable that the fixing roller is arranged above the pressing roller, and the supporting member includes: a pair of vertical pieces opposing each other and spaced apart a distance longer than a length in a rotational axis direction of the fixing roller; a horizontal connecting piece connecting upper end portions of the pair of vertical pieces; and an attachment piece extending downward from the connecting piece, and each of the vertical piece is formed with a hole to which a rotational shaft of the fixing roller is to be fitted, and the attachment piece has an engaging portion to which the retaining member is to be engaged.

Further, it is preferable that the fixing device further includes: a stopper for restricting rotation of the supporting member, and the stopper is arranged at a position of coming in contact with the connecting piece when the supporting member rotates to a predetermined angle.

A image forming apparatus in accordance with yet another aspect of the present invention includes: an image forming section for forming a toner image and transferring the toner image onto a transfer member; and a fixing device for fixing the toner image onto the transfer member, wherein the fixing device includes; a fixing roller; a support roller arranged apart from the fixing roller; an endless fixing belt wound around the fixing roller and the support roller; a pressing roller for applying a pressure force to the fixing roller while the fixing belt being sandwiched between the fixing roller and the pressing roller; a nip extending member arranged on an upstream of the fixing roller and on an inner side of the fixing belt and having a pressing surface for pressing the fixing belt; and a variable mechanism for changing a state of a pressure applied to the fixing belt by the nip extending member.

According to this configuration, a state of pressure applied by the nip extending member to the fixing belt can be changed by the variable mechanism . Accordingly, tilting of the pressing surface in the width direction of the fixing belt and strength of the pressure to the fixing belt can be adjusted properly.

This application is based on Japanese Patent application serial Nos. 2007-135307 and 2007-135308 both filed in Japan Patent Office on May 22, 2007, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A fixing device comprising:

a fixing roller;

a support roller arranged apart from the fixing roller;

an endless fixing belt wound around the fixing roller and the support roller;

a pressing roller for applying a pressure force to the fixing roller while the fixing belt being sandwiched between the fixing roller and the pressing roller;

a nip extending member arranged on an upstream of the fixing roller and on an inner side of the fixing belt and having a pressing surface for pressing the fixing belt, the nip extending member being long in a width direction of the fixing belt; and a variable mechanism for changing a state of a pressure applied to the fixing belt by the nip extending member, the variable mechanism including a swing mechanism for changing vertical positions of the pressing surface of the nip extending member to be relatively different at one side and the other side in the width direction of the fixing belt, the swing mechanism being adapted to support the nip extending member pivotally about a point of a portion corresponding to a substantially center portion in the longitudinal direction of the nip extending member.

2. The fixing device according to claim 1, further comprising:

a driving device for rotationally driving the pressing roller, wherein rotation of the pressing roller rotationally drives the fixing belt.

3. The fixing device according to claim 1, wherein the variable mechanism further includes a rotating mechanism for rotating the pressure surface of the nip extending member about an axis extending in a direction which is the same as that of a rotational axis of the fixing roller.

4. The fixing device according to claim 1, wherein the swing mechanism pivotally supports the nip extending member for pivoting movement about a pivot axis substantially normal to the rotational axis of the fixing roller.

5. The fixing device according to claim 3, wherein the rotating mechanism includes:

a supporting member supported at opposite end portions in a rotational axis of the fixing roller rotatably about the rotational axis; and a biasing member for applying a rotational force to the supporting member for rotation about the rotational axis; wherein the nip extending member is mounted to the supporting member, and the pressing surface is urged by the biasing member in a direction of coming close to a nip portion between the fixing roller and the pressing roller.

6. The fixing device according to claim 5, wherein the nip extending member includes an elastic member on the pressing surface.

7. The fixing device according to claim 6, wherein the rotating mechanism includes a stopper for restricting rotation of the supporting member so that the elastic member is prevented from being tucked into the nip portion.

8. The fixing device according to claim 3, wherein the rotating mechanism includes:

a supporting member supported at opposite end portions in a rotational axis of the fixing roller rotatably about the rotational axis; and a biasing member for applying a rotational force to the supporting member for rotation about the rotational axis, and the nip extending member is mounted to the supporting member, and the pressing surface is urged by the biasing member in a direction of coming close to a nip portion between the fixing roller and the pressing roller.

9. A fixing device comprising:

a fixing roller;

a support roller arranged apart from the fixing roller;

an endless fixing belt wound around the fixing roller and the support roller;

a pressing roller for applying a pressure force to the fixing roller while the fixing belt being sandwiched between the fixing roller and the pressing roller;

a nip extending member arranged on an upstream of the fixing roller and on an inner side of the fixing belt and having a pressing surface for pressing the fixing belt;

a retaining member for supporting the nip extending member pivotally at a portion corresponding to a substantially center portion in a longitudinal direction of the nip extending member;

a supporting member supported at opposite end portions in a rotational axis of the fixing roller rotatably about the rotational axis;

a biasing member for applying a rotational force to the supporting member for rotation about the rotational axis; and a stopper for restricting rotation of the supporting member, wherein the fixing roller is arranged above the pressing roller, the nip extending member is mounted to the supporting member by the retaining member, the pressing surface is urged by the biasing member in a direction of coming close to a nip portion between the fixing roller and the pressing roller, the supporting member includes:

a pair of vertical pieces opposing each other and spaced apart a distance longer than a length in a rotational axis direction of the fixing roller;

a horizontal connecting piece connecting upper end portions of the pair of vertical pieces; and an attachment piece extending downward from the connecting piece, and each of the vertical pieces is formed with a hole to which a rotational shaft of the fixing roller is to be fitted, and the attachment piece has an engaging portion to which the retaining member is to be engaged, and the stopper is arranged at a position of coming in contact with the connecting piece when the supporting member rotates to a predetermined angle.

10. An image forming apparatus comprising:

an image forming section for forming a toner image and transferring the toner image onto a transfer member; and a fixing device for fixing the toner image onto the transfer member, wherein the fixing device includes;

a fixing roller;

a support roller arranged apart from the fixing roller;

an endless fixing belt wound around the fixing roller and the support roller;

a pressing roller for applying a pressure force to the fixing roller while the fixing belt being sandwiched between the fixing roller and the pressing roller;

a nip extending member arranged on an upstream of the fixing roller and on an inner side of the fixing belt and having a pressing surface for pressing the fixing belt, the nip extending member being long in a width direction of the fixing belt; and a variable mechanism for changing a state of a pressure applied to the fixing belt by the nip extending member, the variable mechanism including a swing mechanism for changing vertical positions of the pressing surface of the nip extending member to be relatively different at one side and the other side in the width direction of the fixing belt, the swing mechanism being adapted to support the nip extending member pivotally about a point of a portion corresponding to a substantially center portion in the longitudinal direction of the nip extending member.

11. The image forming apparatus according to claim 10, wherein the swing mechanism pivotally supports the nip extending member for pivoting movement about a pivot axis substantially normal to the rotational axis of the fixing roller.

* * * * *